US006444621B1

(12) United States Patent
Okaniwa et al.

(10) Patent No.: US 6,444,621 B1
(45) Date of Patent: Sep. 3, 2002

(54) GREASE COMPOSITION FOR STEERING OF MOTORCARS

(75) Inventors: Takashi Okaniwa; Akira Taniguchi, both of Fujisawa; Fumio Ueda, Toyota, all of (JP)

(73) Assignees: Koyodo Yushi Co., Ltd., Tokyo (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/639,853

(22) Filed: Aug. 16, 2000

(30) Foreign Application Priority Data

Aug. 27, 1999 (JP) ..... 11-241631

(51) Int. Cl.[7] ..... C10M 115/08; C10M 169/06

(52) U.S. Cl. ..... 508/168; 508/181; 508/183; 508/258; 508/364; 508/379; 508/552

(58) Field of Search ..... 508/181, 182, 508/183

(56) References Cited

U.S. PATENT DOCUMENTS 3,671,429 A * 6/1972 Wright ..... 252/25
4,115,284 A * 9/1978 Kinoshita et al. ..... 252/29
5,037,564 A * 8/1991 Nishizaki et al. ..... 252/22
5,604,187 A * 2/1997 Takeuchi et al. ..... 508/168
5,763,369 A * 6/1998 Baumgart et al. ..... 508/183
5,874,388 A * 2/1999 Hsu ..... 508/183
5,962,377 A * 10/1999 Baumgart et al. ..... 508/168

FOREIGN PATENT DOCUMENTS

JP 61-12791 1/1986

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

A grease composition for steering of motorcars which comprises the following components (a) to (f): (a) a thickening agent; (b) a base oil having a pour point of not higher that −40° C.; (c) an organic molybdenum compound; (d) melamine cyanurate; (e) polytetrafluoroethylene; and (f) molybdenum disulfide. The grease composition has load resistance, or seizure-preventing ability and wear-reducing ability high enough to use the grease under severe lubricating conditions, and can impart, to the steering of motorcars, excellent operability at a low temperature.

13 Claims, No Drawings

GREASE COMPOSITION FOR STEERING OF MOTORCARS

FIELD OF THE INVENTION

The present invention relates to a grease composition for motorcars. More specifically, the present invention pertains to a grease composition for steering of motorcars, which can suitably be used under severe lubricating conditions at gear portions of the steering and which can ensure quite satisfactory operability of these portions at a low temperature.

BACKGROUND OF THE INVENTION

There are a lot of portions in the steering, which requires lubrication. A quite high contact pressure may be generated at, in particular, rack and pinion portions and engaged portions of, for instance, the hypoid gears of pinion assist type electric power steering and may cause seizure and wear. In addition, these portions must be operated over a wide temperature range and therefore, a high operational torque is required at, in particular, a low temperature and this results in failures in the operations of these portions.

As the lubricating greases used in the steering, in particular, those used in the rack and pinion portions, there have been used extreme pressure greases, each of which comprises a lithium soap as a thickening agent, a mineral oil as a base oil, molybdenum disulfide and extreme pressure additives. However, these greases for the steering have not necessarily been satisfied under severe load conditions required for high performance motorcars provided with the recent power steering mechanism.

As a progress has recently been made in easy driving, the electronic control power steering has widely been used in view of the space for fitting the same in light cars. The electronic control power steering used in these motorcars includes column assist type, pinion assist type and rack assist type ones. Among these, pinion assist type hypoid gear portions are operated under extremely high load conditions. Therefore, these gear portions may be liable to cause seizure and abnormal wear and this in turn requires the use of a grease having high extreme pressure properties and high wear resistance. Moreover, this electronic control power steering is also effective for the improvement of the fuel consumption and accordingly, it has been fitted not only to light cars, but also to medium-sized cars and the load conditions have increasingly been severer as compared with the conventional ones. For this reason, any conventional grease has not always been able to eliminate the foregoing problems of seizure and abnormal wear.

In addition, the output of the electronic control power steering is lower than that of the hydraulic type power steering. Therefore, the conventional grease results in a high operational torque at a low temperature and the use thereof leads to insufficient operations of the power steering. The low operability of the power steering at a low temperature observed when the conventional grease is used becomes a serious problem.

SUMMARY OF THE INVENTION

Accordingly, it is an object of the present invention to provide a grease composition for steering of motorcars, which has load resistance, or seizure-preventing ability and wear-reducing ability high enough to use the grease under these severe lubricating conditions, and which can impart, to the steering of motorcars, excellent operability at a low temperature.

The foregoing object of the present invention can effectively be accomplished by providing a grease composition for steering of motorcars comprising the following components (a) to (f): (a) a thickening agent; (b) a base oil having a pour point of not higher than −40° C.; (c) an organic molybdenum compound; (d) melamine cyanurate; (e) polytetrafluoroethylene; and (f) molybdenum disulfide.

DESCRIPTION OF THE PREFERRED EMBODIMENTS

In the present invention, the base oil preferably used may be one containing at least one member selected from the group consisting of synthetic hydrocarbon oils, ester oils and mineral oils.

In a preferred embodiment, the grease composition of the invention comprises, on the basis of the total weight of the composition, 1 to 25% by weight of a thickening agent, 0.1 to 10% by weight of an organic molybdenum compound, 0.1 to 10% by weight of melamine cyanurate, 0.1 to 10% by weight of polytetrafluoroethylene, and 0.1 to 10% by weight of molybdenum disulfide.

In another preferred embodiment, the grease composition of the invention comprises, as the thickening agent, at least one member selected from the group consisting of lithium soap, lithium complex soap and urea compounds, in particular, lithium soap and/or lithium complex soap.

A particularly preferred grease composition of the present invention comprises, on the basis of the total weight of the composition, 3 to 20% by weight of lithium soap or lithium complex soap; 1 to 8% by weight of molybdenum dithiocarbamate or molybdenum dithiophosphate; 1 to 8% by weight of melamine cyanurate; 1 to 8% by weight of polytetrafluoroethylene; 1 to 8% by weight of molybdenum disulfide; and the balance of a base oil selected from the group consisting of synthetic hydrocarbon oils, ester oils, mineral oils and mixture thereof and any other additives.

Each component of the grease composition of the present invention will further be detailed below, individually.

(a) Thickening Agent

The thickening agents used in the composition of the present invention may be any ones presently used in conventional grease compositions, for instance, metallic soap represented by lithium soap and calcium soap; complex soap represented by calcium complex soap, lithium complex soap and aluminum complex soap; sodium terephthalate; urea compounds; organic bentonite; and silica.

Among these, preferred are widely used lithium soap, lithium complex soap and urea compounds because they have only a small number of disadvantages.

In the grease composition of the present invention, the content of the thickening agent preferably ranges from 1 to 25% by weight and more preferably 3 to 20% by weight based on the total weight of the composition. This is because if the content thereof is less than 1% by weight, the thickening effect thereof is too low and the resulting grease composition is too soft and this sometimes becomes a cause of leakage of the grease from lubricating portions. On the other hand, if it exceeds 25% by weight, the resulting grease composition is too hard to easily penetrate into lubricating portions and to sufficiently prevent any seizure of the portions.

(b) Base Oil

The base oil used in the present invention is one having a pour point of not higher than −40° C. and preferably not higher than −45° C. Examples of such base oils are lubricating oils commonly used as the base oils for greases such as mineral oils, synthetic oils represented by ester oils, synthetic hydrocarbon oils, phenyl ethers and polyglycols as well as mixtures of at least two of them. Among them, preferred are ester oils, synthetic hydrocarbon oils, mineral oils and mixtures of at least two of them.

(c) Organic Molybdenum Compounds

The organic molybdenum compound usable in the present invention may be any molybdenum atom-containing organic compound, but preferred are, for instance, molybdenum dithiocarbamate and molybdenum dithiophosphate. Examples of the molybdenum dithiocarbamate preferably used herein are those represented by the following general formula:

$$[R^1R^2N—CS—S]_2—Mo_2O_mS_n$$

wherein $R^1$ and $R^2$ each independently represents an alkyl group having 1 to 24 and preferably 3 to 18 carbon atoms; and m ranges from 0 to 3 and n ranges from 4 to 1, provided that m+n=4.

In addition, preferred examples of molybdenum dithiophosphates are those represented by the following general formula:

$$[R^1—O—PS(O—R^2)—S]_2—Mo_2O_mS_n$$

wherein $R^1$ and $R^2$ each independently represents a primary or secondary alkyl group having 1 to 24 and preferably 3 to 20 carbon atoms; or an aryl group having 6 to 30 and preferably 8 to 18 carbon atoms; m ranges from 0 to 3 and n ranges from 4 to 1, provided that m+n=4.

In the grease composition of the present invention, the content of the organic molybdenum compound preferably ranges from 0.1 to 10% by weight and more preferably 1 to 8% by weight based on the total weight of the composition. This is because if the content thereof is less than 0.1% by weight, the effect of the addition thereof is not always sufficient, while if it exceeds 10% by weight, any further improvement of the effect cannot be expected.

(d) Melamine Cyanurate

The melamine cyanurate used in the grease composition of the present invention is a melamine-isocyanuric acid adduct and is the generic name for melamine-cyanuric acid adducts and melamine-isocyanuric acid adducts. The melamine cyanurate is a substance known as a solid lubricating agent and commercially available in the form of white fine powder having a particle size ranging from 0.1 to 2 $\mu$m. The details thereof are disclosed in Japanese Un-Examined Patent Publication No. Sho 54-141792. The lubrication mechanism of the melamine cyanurate would be as follows: A melamine molecule having a 6-membered structure and a cyanuric acid molecule are strongly linked together through hydrogen bonds formed between them, thus they are arranged in a plane and the planes lie one on top of another through weak bond strength acting therebetween. For this reason, the melamine cyanurate would have cleaving properties like molybdenum disulfide.

In the grease composition of the present invention, the content of melamine cyanurate preferably ranges from 0.1 to 10% by weight and more preferably 1 to 8% by weight based on the total weight of the composition. This is because if the content thereof is less than 0.1% by weight, the effect of the addition thereof is not always sufficient, while if it exceeds 10% by weight, any further improvement of the effect cannot be expected.

(e) Polytetrafluoroethylene

The polytetrafluoroethylene used in the present invention is one commonly used in the fields of, for instance, rubber, paints and varnishes, inks and lubricating agents in addition to greases and generally used are those having a molecular weight ranging from several thousands to several hundreds of thousands. The cohesive energy of the polytetrafluoroethylene is low as compared with those of other high molecular weight compounds and the critical surface tension thereof is quite low. Therefore, polytetrafluoroethylene particles present in portions, which undergo sliding motions, are broken into fine and thin pieces due to the shear stress originated from the sliding motions and are liable to cause spreading on and adhesion to the counterpart of the sliding portions. Accordingly, the polytetrafluoroethylene may impart excellent lubricating properties to the resulting grease composition.

In the grease composition of the present invention, the content of the polytetrafluoroethylene preferably ranges from 0.1 to 10% by weight and more preferably ranges from 1 to 8% by weight on the basis of the total weight of the grease composition. This is because if the content thereof is less than 0.1% by weight, the effect of the addition thereof is not always sufficient, while if it exceeds 10% by weight, any further improvement of the effect cannot be expected.

(f) Molybdenum Disulfide

In general, molybdenum disulfide has widely been used as a solid lubricating agent. The lubricating mechanism thereof has been considered to be as follows: molybdenum disulfide has a layer lattice structure and accordingly, it is easily cleaved into thin layers by a shearing force due to the sliding motions of portions to be lubricated and may thus reduce any friction at the portions. There have been known molybdenum disulfide having a variety of particle sizes and those having any particle size and commonly used in lubricating agents may be employed in the present invention, but particularly suitably used herein are those having an average particle size, as determined using a Fisher Sub-sieve sizer, ranging from 0.25 to 10 $\mu$m.

In the grease composition of the present invention, the content of the molybdenum disulfide preferably ranges from 0.1 to 10% by weight and more preferably ranges from 1 to 8% by weight on the basis of the total weight of the composition. This is because if the content thereof is less than 0.1% by weight, the effect of the addition thereof is not always sufficient, while if it exceeds 10% by weight, any further improvement of the effect cannot be expected.

In addition to the foregoing components, the grease composition of the present invention may further comprise additives currently used in grease compositions such as other load resistance-improving agents, antioxidants, rust-proofing agents and corrosion inhibitors.

The present invention will hereunder be described in more detail with reference to the following working Examples, but the present invention is not restricted to these specific Examples at all.

In the following Examples and Comparative Examples, the components specified in the following Tables 1 and 2 were used in the rates (part by weight) as specified in Tables 1 and 2 to thus prepare grease compositions of Examples 1 to 5 and Comparative Examples 1 to 6. These grease compositions and a commercially available grease (Comparative Example 7) were inspected for their physical properties according to the following test methods. The results thus obtained are summarized in Tables 1 and 2.

EXAMPLES 1 TO 5 AND COMPARATIVE EXAMPLES 1 TO 6

To 2500 g of the base oil, there was added 500 g of lithium 12-hydroxy stearate with stirring and then the resulting mixture was heated to 210° C. After the heating, the mixture was cooled to 160° C., followed by addition of 2000 g of the base oil and cooling the mixture to a temperature of not higher than 100° C. with stirring to thus give a base lithium grease. To this base grease, there were added other additives in the amounts specified in Tables 1 and 2 and the base oil was, if necessary, added to the resulting mixture followed by the control of the penetration thereof to No. 2 Grade using a three-roll mill. In this regard, the content of the base oil in each grease composition was adjusted to the level specified in Table 1 or 2.

COMPARATIVE EXAMPLE 7

This grease composition is a commercially available grease comprising lithium soap as a thickening agent and a mineral oil as a base oil and has conventionally been used at the rack and pinion portions.

Methods for Inspecting Physical Properties

[Penetration]

This was determined according to JIS K2220 5.3.

[High Speed Four Balls Load Resistance Properties]

This was determined according to ASTM D2596.

[Test for Durability on Engine Bench]

The durability on the engine bench test was carried out using a real pinion assist type electronic control power steering.

(Test Method)

A desired amount of each test grease composition was applied to rack and pinion portions, hypoid gear portions and other portions to be lubricated, and then steering was repeated over a predetermined number of revolutions by inputting power through the rack portion to thus evaluate the amount of wear of each portion as well as the degree of seizure thereof.

(Test Conditions)

Load Inputted through Rack: 5000 N

Number of Steerings: 100,000 times

Temperature of Atmosphere: ordinary temperature (Evaluation Criteria)

○: There was not observed any seizure (pass).

×: Seizure was observed at hypoid gear portions (fail).

××: There were observed seizure on both hypoid gear and rack and pinion portions (fail).

[Low Temperature Test on Engine Bench]

The low temperature operability was evaluated using a real pinion assist type electronic control power steering.

(Test Method)

A desired amount of each test grease composition was applied to rack and pinion portions, hypoid gear portions and other portions to be lubricated as in the evaluation of the durability, the temperature of the atmosphere was adjusted to a predetermined level and the initial torque of the steering shaft was determined at the initiation of the steering, in terms of the value relative to the torque observed for the conventional product (the latter was assumed to be 100).

(Temperature of Atmosphere): −30° C.

(Evaluation Criteria)

less than 10: pass;

not less than 10: fail

The results obtained in Examples 1 to 5 and Comparative Examples 1 to 6 clearly indicate that it is necessary to simultaneously use 4 kinds of components, i.e., an organic molybdenum compound, melamine cyanurate, polytetrafluoroethylene and molybdenum disulfide in order to pass the durability on engine bench test. More specifically, seizure is observed at hypoid gear and rack and pinion portions even when only one out of these four components is omitted and thus the grease composition never passes the test for durability on engine bench.

The grease composition of Comparative Example 1 exhibited sufficiently high speed 4-balls load resistance properties on the order of 800 kgf<, but it caused seizure at the hypoid portions. The reason for this has not yet been clearly elucidated, but this fact would suggest that the roles of these four kinds of solid lubricating agents differ from one another, that there are additional properties, which cannot be evaluated by the extreme pressure quality (such as smoothening of the surface to be lubricated over a long period of time) and that such properties may play an important role.

To obtain a grease composition showing excellent low temperature operability, it is important to use a base oil having a pour point of not higher than −40° C. In case of Comparative Example 6, the grease composition has a high pour point on the order of −37.5° C., although the kinematic viscosity as determined at 40° C. is low. For this reason, the grease composition of Comparative Example 6 is inferior in low temperature operability.

TABLE 1

| | Examples No. | | | | |
|---|---|---|---|---|---|
| | 1 | 2 | 3 | 4 | 5 |
| Thickening Agent; 1) Li 12-hydroxystearate | 10.0 | 10.0 | 10.0 | 10.0 | 10.0 |
| Base Oil | | | | | |
| 2) Synthetic Hydrocarbon Oil | 70.0 | — | — | 41.0 | 29.0 |
| 3) Synthetic Hydrocarbon Oil | — | — | — | — | — |
| 4) Ester Oil | — | 70.0 | 35.0 | 41.0 | 29.0 |
| 5) Mineral Oil | — | — | 35.0 | — | — |
| 6) Mineral Oil | — | — | — | — | — |
| Kinematic Viscosity(40° C.), $mm^2/s$ | 30.0 | 11.6 | 31.0 | 18.0 | 18.0 |
| Pour Point, ° C. | −62.5 | −60.0 | −47.5 | −60.0 | −60.0 |
| Additives | | | | | |
| 7) Molybdenum Dithiocarbamate | 5.0 | 5.0 | 5.0 | 2.0 | 8.0 |
| 8) Melamine Cyanurate | 5.0 | 5.0 | 5.0 | 2.0 | 8.0 |
| 9) Polytetrafluoroethylene | 5.0 | 5.0 | 5.0 | 2.0 | 8.0 |
| 10) Molybdenum Disulifide | 5.0 | 5.0 | 5.0 | 2.0 | 8.0 |
| 11) Penetration, 60 W | 281 | 285 | 270 | 295 | 255 |
| 12) High Speed 4-Balls Load Resistance Properties, WP kgf | 800< | 800< | 800< | 400 | 800< |
| 13) Durability Test on Engine Bench | ○ | ○ | ○ | ○ | ○ |
| 14) Low Temp. Test on Engine Bench | Pass (10>) | Pass (10>) | Pass (10>) | Pass (10>) | Pass (10>) |

TABLE 2

| | Comparative Examples No. | | | | | | |
|---|---|---|---|---|---|---|---|
| | 1 | 2 | 3 | 4 | 5 | 6 | 7* |
| Thickening Agent: 1) Li 12-hydroxystearate | 10.0 | 10.0 | 10.0 | 10.0 | 10.0 | 10.0 | |

TABLE 2-continued

| | Comparative Examples No. | | | | | | |
|---|---|---|---|---|---|---|---|
| | 1 | 2 | 3 | 4 | 5 | 6 | 7* |
| Base Oil | | | | | | | |
| 2) Synthetic Hydrocarbon Oil | 70.0 | 70.0 | 70.0 | 70.0 | — | — | |
| 3) Synthetic Hydrocarbon Oil | — | — | — | — | 70.0 | — | |
| 4) Ester Oil | — | — | — | — | — | 35.0 | |
| 5) Mineral Oil | — | — | — | — | — | — | |
| 6) Mineral Oil | — | — | — | — | — | 35.0 | |
| Kinematic Viscosity (40° C.), $mm^2/s$ | 30.0 | 30.0 | 30.0 | 30.0 | 410 | 27.3 | |
| Pour Point, ° C. | −62.5 | −62.5 | −62.5 | −62.5 | −27.5 | −37.5 | |
| Additives | | | | | | | |
| 7) Molybdenum Dithiocarbamate | 7.0 | 7.0 | 7.0 | — | 5.0 | 5.0 | |
| 8) Melamine Cyanurate | 7.0 | 6.0 | — | 7.0 | 5.0 | 5.0 | |
| 9) Polytetrafluoro-ethylene | 6.0 | — | 6.0 | 6.0 | 5.0 | 5.0 | |
| 10) Molybdenum Disulfide | — | 7.0 | 7.0 | 7.0 | 5.0 | 5.0 | |
| 11) Penetration 60 W | 285 | 290 | 283 | 281 | 260 | 273 | 280 |
| 12) High Speed 4-Balls Load Resistance Test | 800< | 620 | 400 | 315 | 800< | 800< | 315 |
| 13) Durability Test on Engine Bench | X | X | XX | XX | ○ | ○ | XX |
| 14) Low Temp. Test on Engine Bench | Pass (10>) | Pass (10>) | Pass (10>) | Pass (10>) | Fail (140) | Fail (60) | Fail (100) |

1) Lithium 12-Hydroxystearate (trade name: S-7000H, available from Sakai Chemical Industry Co., Ltd.).
2) Synthetic Hydrocarbon Oil (trade name: MOBIL SHF61, available from Mobil Chemical Co., Ltd.).
3) Synthetic Hydrocarbon Oil (trade name: MOBIL SHF401, available from Mobil Chemical Co., Ltd.).
4) Ester Oil (trade name: DOS, available from New Japan Chemical Co., Ltd.).
5) Mineral Oil (trade name: STANOL LP-40; available from Esso Petroleum Co., Ltd.).
6) Mineral Oil (trade name: FUKKOL NT-200, available from Fuji Kosan Co., Ltd.).
7) Molybdenum Dithiocarbamate (trade name: Molyvan A, available from R.T. Vanderbilt Company).
8) Melamine Cyanurate (trade name: MCA, available from Mitsubishi Chemical Co., Ltd.).
9) Polytetrafluoroethylene (trade name: LUBRONE L-5F, available from Daikin Industries, Ltd.).
10) Molybdenum Disulfide (technical fine grade) (trade name: Molysulfide, available from CLIMAX MOLYBDENUM COMPANY).
11) Penetration 60 W
12) High Speed 4-Balls Load Resistance Test
13) Durability Test on Engine Bench
14) Low Temp. Test on Engine Bench
*A conventional grease composition, i.e., an extreme pressure grease containing molybdenum disulfide.

What is claimed is:

1. A grease composition for steering of motorcars comprising the following components (a) to (f):

(a) a thickening agent;

(b) a base oil having a pour point of not higher that −40° C.;

(c) an organic molybdenum compound;

(d) melamine cyanurate;

(e) polytetrafluoroethylene; and (f) molybdenum disulfide.

2. The grease composition for steeling of motorcars of claim 1 wherein the thickening agent is at least one member selected from the group consisting of lithium soap, lithium complex soap and urea compounds.

3. The grease composition for steering of motorcars of claim 1 wherein, on the basis of the total weight of the composition, the content of the thickening agent ranges from 1 to 25% by weight, the content of the organic molybdenum compound ranges from 0.1 to 10% by weight, the content of the melamine cyanurate ranges from 0.1 to 10% by weight, the content of the polytetrafluoroethylene ranges from 0.1 to 10% by weight, and the content of the molybdenum disulfide ranges from 0.1 to 10% by weight.

4. The grease composition for steering of motorcars of claim 3 wherein the thickening agent is at least one member selected from the group consisting of lithium soap, lithium complex soap and urea compounds.

5. The grease composition for steering of motorcars of claim 1 wherein the base oil is at least one member selected from the group consisting of synthetic hydrocarbon oils, ester oils and mineral oils.

6. The grease composition for steeling of motorcars of claim 5 wherein the thickening agent is at least one member selected from the group consisting of lithium soap, lithium complex soap and urea compounds.

7. The grease composition for steering of motorcars of claim 5 wherein, on the basis of the total weight of the composition, the content of the thickening agent ranges from 1 to 25% by weight, the content of the organic molybdenum compound ranges from 0.1 to 10% by weight, the content of the melamine cyanurate ranges from 0.1 to 10% by weight, the content of the polytetrafluoroethylene ranges from 0.1 to 10% by weight, and the content of the molybdenum disulfide ranges from 0.1 to 10% by weight.

8. The grease composition for steering of motorcars of claim 7 wherein the thickening agent is at least one member selected from the group consisting of lithium soap, lithium complex soap and urea compounds.

9. The grease composition for steering of motorcars of claim 1 which comprises, on the basis of the total weight of the composition, 3 to 20% by weight of lithium soap or lithium complex soap; 1 to 8% by weight of molybdenum dithiocarbamate or molybdenum dithiophosphate; 1 to 8% by weight of melamine cyanurate; 1 to 8% by weight of polytetrafluoro-ethylene; 1 to 8% by weight of molybdenum disulfide; and the balance of a base oil selected from the group consisting of synthetic hydrocarbon oils, ester oils, mineral oils and mixture thereof and any other additives.

10. The grease composition for steering of motorcars of claim 1 wherein the organic molybdenum compound is a molybdenum dithiocarbamate or a molybdenum dithiophosphate.

11. The grease composition for steering of motorcars of claim 1 wherein the molybdenum dithiocarbamate is one represented by the following general formula:

$$[R^1R^2N—CS—S]_2—Mo_2O_nS_n$$

wherein $R^1$ and $R^2$ each independently represents an alkyl group having 1 to 24 carbon atoms; and m ranges from 0 to 3 and n ranges from 4 to 1, provided that m+n=4, and the molybdenum dithiophosphates is one represented by the following general formula:

$$[R^1—O—PS(O—R^2)—S]_2—Mo_2O_mS_n$$

wherein $R^1$ and $R^2$ each independently represents a primary or secondary alkyl group having 1 to 24 carbon atoms; or an aryl group having 6 to 30 carbon atoms; m ranges from 0 to 3 and n ranges from 4 to 1, provided that m+n=4.

12. The grease composition for steering of motorcars of claim 1 wherein the molybdenum disulfide has an average particle size, as determined using a Fisher Sub-sieve sizer, ranging from 0.25 to 10 $\mu$m.

13. The grease composition for steering of motorcars of claim 1 wherein seizure is not observed at either hypoid gear portions or rack and pinion portions when said composition is subjected to a Test for Durability on Engine Bench.

* * * * *

UNITED STATES PATENT AND TRADEMARK OFFICE

CERTIFICATE OF CORRECTION

PATENT NO. : 6,444,621 B1
DATED : September 3, 2002
INVENTOR(S) : Okaniwa et al.

It is certified that error appears in the above-identified patent and that said Letters Patent is hereby corrected as shown below:

Title page,
Item [73], the Assignee information is incorrect. Item [73] should read:

-- [73] Assignees: Kyodo Yushi Co., Ltd., Tokyo (JP);
Toyota Jidosha Kabushiki Kaisha,
Toyota (JP) --

Signed and Sealed this

Seventeenth Day of December, 2002

JAMES E. ROGAN
*Director of the United States Patent and Trademark Office*